United States Patent [19]

Kawasaki

[11] 4,066,860

[45] Jan. 3, 1978

[54] PUSHBUTTON SWITCH KEY ARRANGEMENT FOR KEYBOARDS HAVING INDICIA

[75] Inventor: Hiroshi Kawasaki, Yamatokoriyama, Japan

[73] Assignee: Sharp Kabushiki Kaisha, Osaka, Japan

[21] Appl. No.: 616,649

[22] Filed: Sept. 25, 1975

[30] Foreign Application Priority Data

| | | |
|---|---|---|
| Sept. 26, 1974 | Japan | 49-113137 |
| Oct. 2, 1974 | Japan | 49-114083 |
| Dec. 13, 1974 | Japan | 49-143913 |

[51] Int. Cl.[2] ..... H01H 9/00; H01H 13/14

[52] U.S. Cl. ..... 200/308; 200/5 A; 200/159 A; 200/159 B; 200/275; 200/340

[58] Field of Search ..... 200/5 R, 5 A, 159 R, 200/159 A, 159 B, 86 R, 308, 340; 197/98, 101, 102

[56] References Cited

U.S. PATENT DOCUMENTS

| | | | |
|---|---|---|---|
| 3,582,594 | 1/1971 | Twyford | 200/340 |
| 3,612,802 | 10/1971 | Beadle et al. | 200/340 X |
| 3,627,927 | 12/1971 | Schmitz et al. | 200/159 B UX |
| 3,823,309 | 7/1974 | Caruso | 200/5 A X |
| 3,856,998 | 12/1974 | Sims, Jr. | 200/340 X |
| 3,860,771 | 1/1975 | Lynn et al. | 200/340 X |
| 3,932,722 | 1/1976 | Obata et al. | 200/340 |
| 3,950,846 | 4/1976 | Johnson | 200/159 B X |

OTHER PUBLICATIONS

Long, E. E., IBM Tech. Disc. Bull., "Low-Cost Key--Top Structure for Serpentine Strip Keyboard," vol. 17, No. 5, 10-1974, p. 1479.

Yarborough, J. L., IBM Tech. Discl. Bull., "Nonteasable Switch Actuator," vol. 16, No. 5, 10-1973, pp. 1520, 1521.

Johnson, Jr., D. O., IBM Tech. Disc. Bull., "Keyboard and Wiping Contact Assembly," vol. 13, No. 7, 12-1970, pp. 1962, 1963.

*Primary Examiner*—James R. Scott

*Attorney, Agent, or Firm*—Birch, Stewart, Kolasch & Birch

[57] ABSTRACT

Pushbutton switch configurations are provided in which one or a plurality of pushbutton switches are formed with integrated bases, actuating springs and key top structures to facilitate fabrication of arrays of such switches in a substantially unitary matrix or in line configuration. In a preferred embodiment a metal base is etched to form spring and key top frame patterns which are press formed into key top and vertically extending supporting spring structures integral with the base plate in a desired matrix or line configuration. Epoxy or similar resin material can then be integrated with the key top frame to complete each pushbutton switch. Suitable operating indicia are press formed or etched in the key top surfaces and contrasted with resin as desired.

6 Claims, 40 Drawing Figures

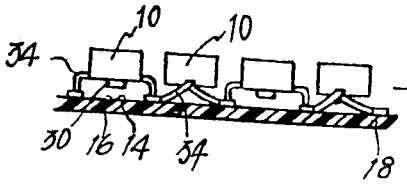
FIG. 6
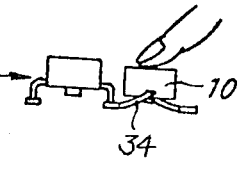
FIG. 7
FIG. 8
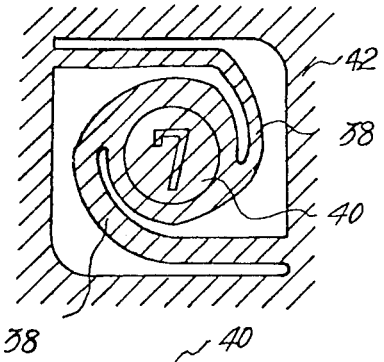
FIG. 9
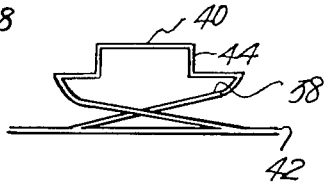
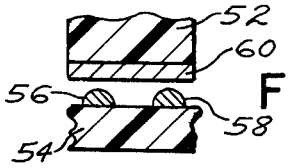
FIG.10A
FIG. 10
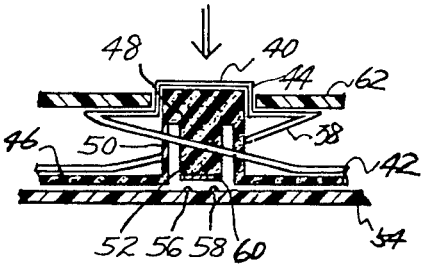
FIG.11A
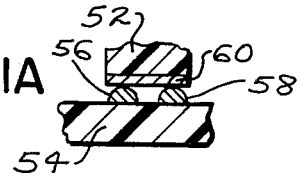
FIG. 11
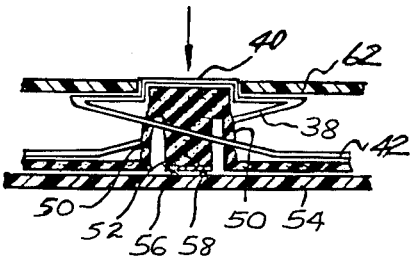

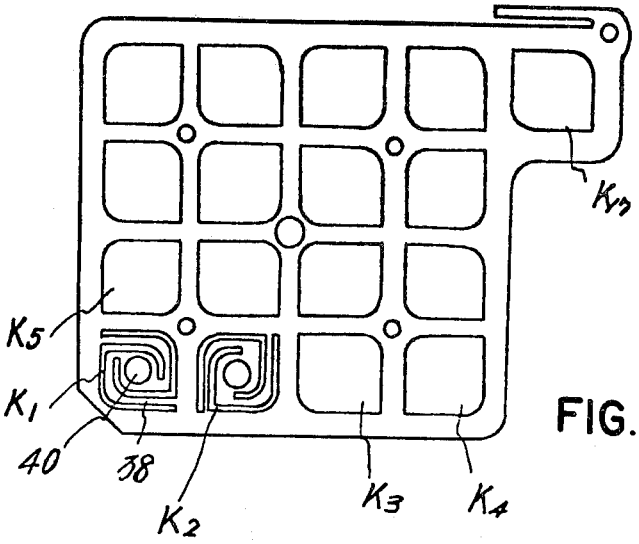
FIG. 12
FIG. 13
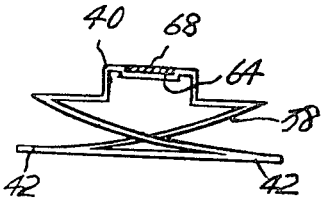
FIG. 14
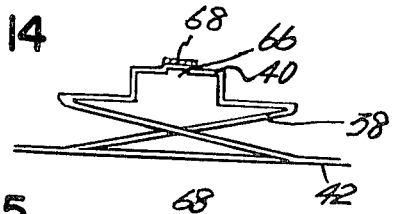
FIG. 15
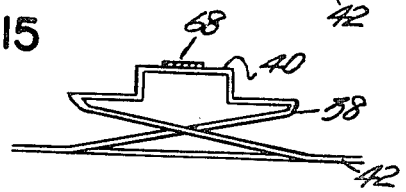
FIG. 16
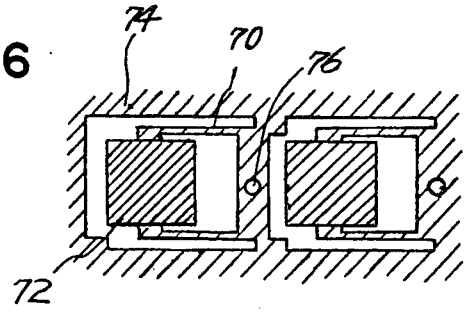
FIG. 17
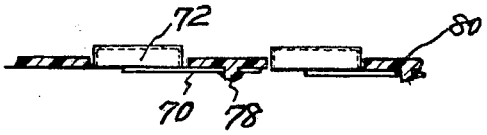
FIG. 18
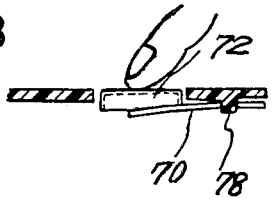

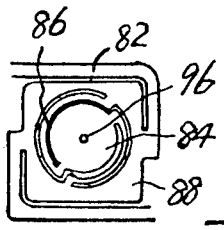
FIG. 19
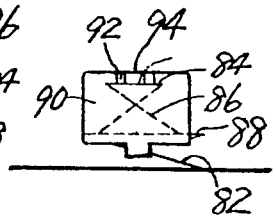
FIG. 20
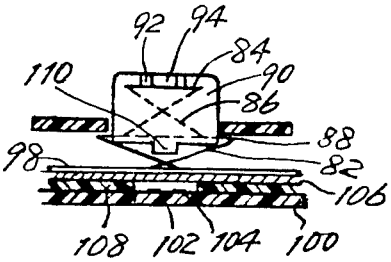
FIG. 23
FIG. 21
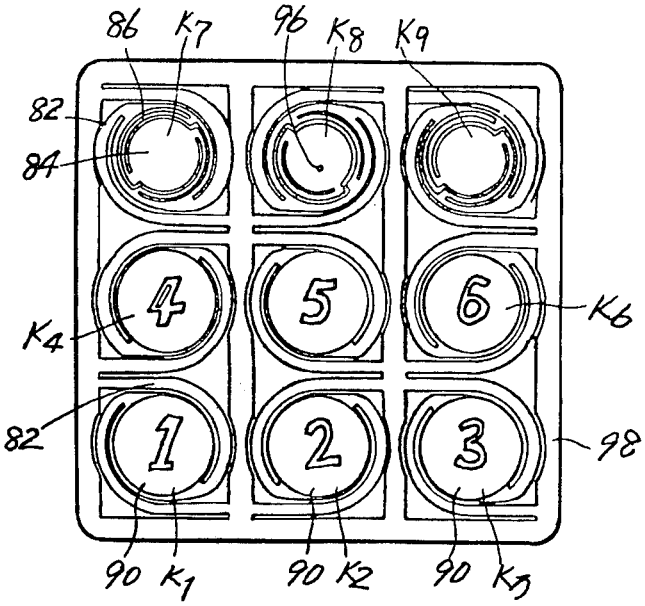
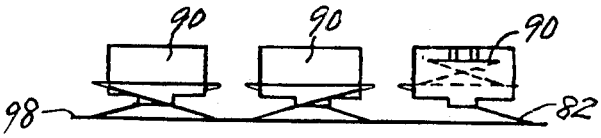
FIG. 22
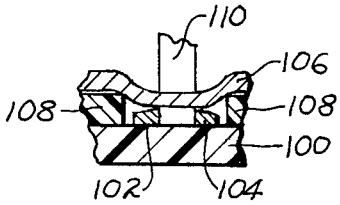
FIG. 23A

PUSHBUTTON SWITCH KEY ARRANGEMENT FOR KEYBOARDS HAVING INDICIA

BACKGROUND AND SUMMARY OF THE INVENTION

Background of the Invention

The present invention relates to a pushbutton switch. Conventional pushbutton switches of the prior art are mainly comprised of a key top and a spring discrete from each other. When these pushbutton switches are used in a keyboard employing a number of key switches for information introduction, both the key tops and the springs are required for respective key switches and, therefore, the fabrication thereof is very troublesome and time consumptive.

Accordingly, an object of the present invention is to simplify the method of fabrication of key switches.

Another object of the present invention is to provide a pushbutton switch which has a key top integral with a spring for movably supporting the key top.

Still another object of the present invention is to provide a keyboard unit of simple construction.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objectives, pursuant to one embodiment of the present invention, a key top integral with a spring is made of elastic material. A number of key tops and springs are formed in a single body or continuously connected with each other, thereby simplifying the construction of a keyboard unit.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

FIG. 6 is a side view of the pushbutton switches employing in the keyboard unit of FIG. 5;

FIG. 7 is a side view showing an operation mode of the pushbutton switches of FIG. 6;

FIG. 8 is a plan view of a frame of still another embodiment of a pushbutton switch of the present invention;

FIG. 9 is a sectional view of the frame of FIG. 8;

FIG. 10 is a sectional view of a pushbutton switch employing the frame of FIG. 8;

FIG. 10A is an enlarged detail of the open condition of the switch contact illustrated in FIG. 10;

FIG. 11 is a sectional view showing an operation mode of the pushbutton switch of FIG. 10;

FIG. 11A is an enlarged detail of the closed condition of the contacts illustrated in FIG. 11;

FIG. 12 is a plan view of a keyboard unit employing the frame of FIG. 8;

FIG. 13 is an embodiment illustrating markings or operational indicia on a pushbutton switch employing the frame of FIG. 8;

FIG. 14 is another embodiment of markings or operational indicia on a pushbutton switch employing the frame of FIG. 8;

FIG. 15 is still another embodiment of markings or operational indicia on a pushbutton switch employing the frame of FIG. 8;

FIG. 16 is a plan view of yet another embodiment of pushbutton switches of the present invention;

FIG. 17 is a sectional view of the pushbutton switches of FIG. 16; FIG. 18 is a sectional view showing an operation mode of the pushbutton switches of FIG. 16;

FIG. 19 is a plan view of a further embodiment of a frame of a pushbutton switch of the present invention;

FIG. 20 is a schematic sectional view of a pushbutton switch employing the frame of FIG. 19;

FIG. 21 is a top plan view of a keyboard unit employing the pushbutton switches of FIG. 20;

FIG. 22 is a schematic side view of the keyboard unit of FIG. 21;

FIG. 23 is a schematic sectional view of detailed construction of the pushbutton switch of FIG. 20;

FIG. 23A is an enlarged detail of a closed condition of the contacts of the switch of FIG. 23;

DESCRIPTION OF THE PREFERRED EMBODIMENTS

Figure 1:
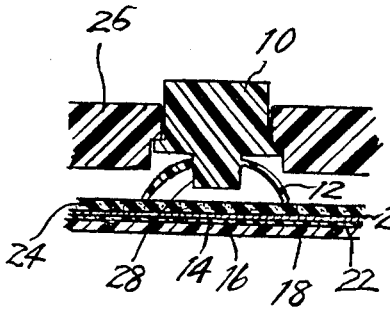
FIG. 1 is a sectional view of an embodiment of a pushbutton switch of the present invention.

Referring now to FIG. 1, there is illustrated an embodiment of a pushbutton switch of the present invention, in which a key top 10 is integral with a spring means 12 and made of elastic resin such as polypropylene.

A pair of comb-shaped key contact patterns 14 and 16 are formed directly on a substrate 18. A conductive rubber plate 20 is disposed on the substrate 18 via a spacer 22. A rubber cushion 24 is disposed on the conductive rubber plate 20 and the key top 10 integral with the spring means 12 is installed on the rubber cushion 24 to correspond with the key contact patterns 14 and 16. The position of the key top 10 is determined by a cabinet 26 of an electronic apparatus such as an electronic calculator.

Figure 2:
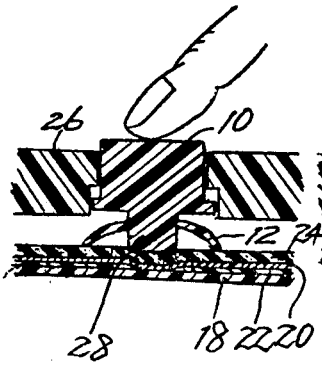
FIG. 2 is a sectional view showing an operation mode of the pushbutton switch of FIG. 1.

When the key top 10 is manually depressed downward as shown in FIG. 2, a projection portion 28 integral with the key top 10 and the spring means 12 depresses the conductive rubber plate 20 downward, whereby the comb-shaped key contact patterns 14 and 16 are shunted.

Figure 3:
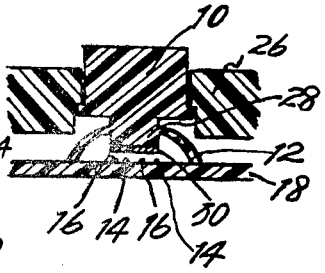
FIG. 3 is a sectional view of another embodiment of a pushbutton switch of the present invention.

FIG. 3 shows another embodiment of the pushbutton switch of the present invention, wherein a conductive rubber layer 30 is attached to the bottom wall of the projection portion 28. In thin embodiment, the conductive rubber plate 20, the spacer 22 and the rubber cushion 24 can be eliminated.

When released, the key top 10 returns its normal position by virtue of the spring means 12, thereby electrically separating the comb-shaped key contact patterns 14 and 16 from each other.

Figure 4:
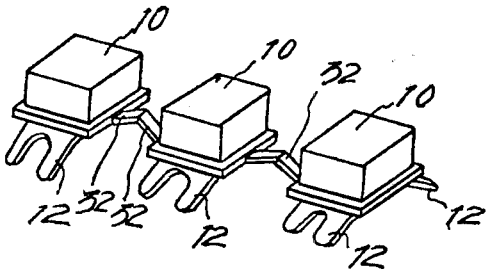
FIG. 4 is a perspective view showing an embodiment comprising an alignment of a plurality of pushbutton switches of the type illustrated in FIG. 1.

The spring means 12 can be constructed to have two legs as shown in FIG. 4 in order to enhance the elasticity. Thin projections or thin connectors 32 integral with the key top 10 are provided to interconnect adjacent key tops 10 in order to facilitate the fabrication of a keyboard unit including the pushbutton switches of the present invention.

Figure 5:
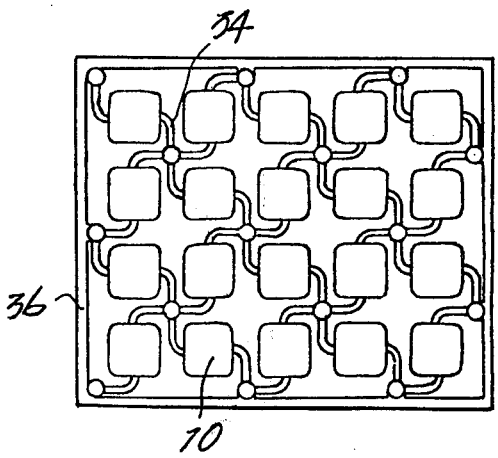
FIG. 5 is a plan view of a keyboard unit employing pushbutton switches of the present invention.

FIG. 5 shows a matrix aligned keyboard unit, wherein the key tops 10 and thin connectors 34 are formed in a single body with the use of elastic resin. A keyboard panel frame 36 integral with the key tops 10 will be effective to facilitate the installation of the keyboard unit in the electronic apparatus.

The thin connectors 34 do not disturb the downward movement of the respective key tops 10 and, therefore, the key top 10 can be depressed independently from the adjacent key tops as shown in FIGS. 6 and 7. In FIGS. 6 and 7, the spring means 12 are omitted from the drawings in order to simplify the understanding of the movement of the key tops. It will be understood that the thin connectors 34 can be also used as the spring means.

FIGS. 8 through 11A show still another embodiment of a pushbutton switch of the present invention.

A spring means 38 and a key top 40 are formed in a thin metal plate 42 with the use of conventional etching techniques. The key top portion 40 is press formed with a projected portion 44 and the spring means 38 is pulled upward from the etched plate 42 to movably support the key top portion 40 as shown in FIG. 9.

An insulating rubber plate 46 integral with a key top supporter 48, a supporting wall 50 and a projection 52 is disposed on a substrate 54 on which a pair of comb-shaped key contact patterns 56 and 58 are directly formed as shown in FIG. 10. The key top supporter 48 is inserted into the projected portion 44 of the key top 40 to tightly support the key top 40. The spring means 38 is positioned around the supporting wall 50 to enable the downward movement of the key top 40 and the key top supporter 48. A conductive rubber plate 60 is attached to the bottom wall of the projection 52 to shunt the pair of comb-shaped key contact patterns 56 and 58 upon manual depression of the key top 40. The key top portion 40 is protruded outside through a hole provided at a corresponding position of a cabinet 62 of an electronic apparatus.

When the key top 40 is manually depressed downward against the elasticity of the spring means 38 and the supporting wall 50, the conductive rubber plate 60 shunts the key contact patterns 56 and 58 as shown FIGS. 11 and 11A. The key top 40 is returned its original position when released by virtue of the spring means 38 and the supporting wall 50, thereby disconnecting the key contact patterns 56 and 58.

FIG. 12 shows a matrix alignment of the key tops 40 and the spring means 38 on a continuous metal plate 42 in order to provide a keyboard unit having seventeen key switches. The respective key switches $K_1 - K_{17}$ are formed in such a manner as shown in FIGS. 8 through 11A. In FIG. 12, only the key switches $K_1$ and $K_2$ are illustrated in detail and the remaining key switches are illustrated only their positions for the purpose of simplicity, since they are formed in a same manner as the key switches $K_1$ and $K_2$.

FIGS. 13 through 15 show methods for marking the key tops with operating indicia for specifying the respective key switches, for example, numeral keys O – 9 and function keys $\times$, $+$, $\div$, etc.

An indent 64 is provided on the key top 40 by virtue of press forming in the embodiment of FIG. 13. Coatings varnish or suitable resin 68 is painted on the indent 64 to mark indicia on the key top 40. In the embodiment of FIG. 14, a projection 66 is provided on the key top 40, on which the indicia marking is formed. In FIG. 15, the indicia marking is formed on the flat surface of the key top 40.

FIG. 16 shows still another embodiment of a pushbutton switch of the present invention.

A plate-shaped spring means 70 and a key top 72 of a hollow square pole construction is formed on a metal plate 74 with the use of the etching technique and the press technique previously described.

A hole 76 is provided at a desired position of the metal plate 74, whereas a projection 78 is provided on the rear surface of a cabinet 80 of an electronic apparatus at a position corresponding to the hole 76. The projection 78 is inserted into the hole 76 and melted to tightly support the metal plate 74 on the rear surface of the cabinet 80 as shown in FIG. 17.

When the key top 72 is manually depressed downward, the fulcrum of the movement is tightly fixed by the projection 78 and, therefore, the key top 72 can be depressed independently from the adjacent key tops as shown in FIG. 18.

It will be clear that although the key top supporter and the projection having the conductive rubber attached thereon are required below the key top 72, they have been omitted from the drawings for the purpose of simplicity.

Referring now to FIG. 19, there is illustrated another embodiment of a pushbutton switch of the present invention, a spring means 82, a key top surface 84, a key top frame 86, and a supporter or shoulder 88 are formed on a metal plate through the use of the conventional etching technique previously described.

The spring means 82 and the key top frame 86 are pulled upward from the etched metal plate as shown in FIG. 20. A metal pattern is disposed around the key top frame 86 and suitable resin is cast into the metal pattern to form a key top block 90. The metal pattern is preferably formed preclude casting resin at a desired position 92 on the key top surface 84, at which the key top surface 84 can be seen and, therefore, it may be used for marking the key switch. The resin is cast into a region 94 through a hole 96 provided at the center of the key top surface 84.

After fabricating the key top block 90, the spring means 82 is pulled upward from the etched metal plate in order to movably support the key top block 90.

FIG. 21 shows a typical alignment of a keyboard panel utilizing the abovementioned key switches. A desired number of key top blocks 90 are formed and supported by the spring means 82 integral with a panel frame 98 made of a thin metal plate such as a stainless steel plate. In FIG. 21, the key switches $K_7$, $K_8$ and $K_9$ are shown in the condition before the resin casting in order to facilitate the understanding of the fabrication of the keyboard unit.

The hole 96 provided through the key top surface 84 must be formed at a desired position which taken into consideration the ultimate configuration of the marking to be placed on the respective switch.

The respective key top blocks 90 are movably supported by the spring means 82 in order to enable the manual depression of the key top blocks 90 as shown in FIG. 22.

FIGS. 23 and 23A shows a key switch employing the above-mentioned key top installed on a substrate 100. A pair of comb-shaped key contact patterns 102 and 104 are formed directly on the substrate 100 on which a conductive rubber plate 106 is disposed via a spacer 108. When the key top block 90 is manually depressed downward, a projection 110 provided on the bottom wall of the key top block 90 depress the conductive rubber plate 106 downward to shunt the key contact patterns 102 and 104.

FIGS. 24 through 33 show several ways for marking the key switch.

Figure 24:
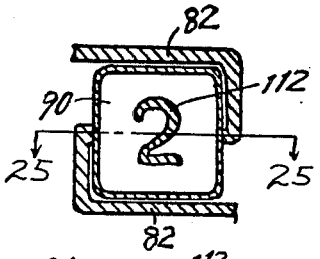
FIG. 24 is a plan view of another embodiment of a pushbutton switch of the present invention.
Figure 25:
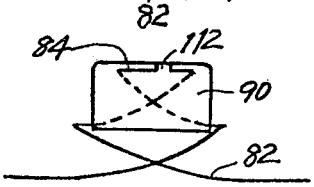
FIG. 25 is a schematic sectional view as seen at 25 — 25 of FIG. 24.

In the embodiment shown in FIGS. 24 and 25, a projection 112 is formed on the key top surface 84 with the use of the press forming technique previously described. The projection 112 is formed in a desired configuration to mark the key switch. The projection 112 is not covered with the resin forming the key top block 90, thereby marking the key switch.

Figure 26:
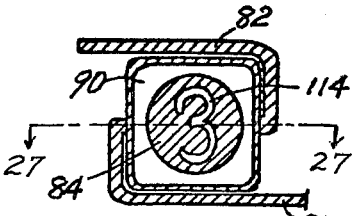
FIG. 26 is a plan view of another embodiment of a pushbutton switch of the present invention.
Figure 27:
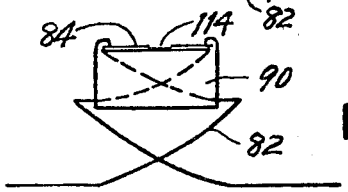
FIG. 27 is a schematic sectional view as seen at 27 — 27 of FIG. 26.

In the embodiment shown in FIGS. 26 and 27, an indent 114 of a suitable configuration is formed on the key top surface 84 to mark the key switch with the use of the etching technique previously described. The key top surface 84 is not covered with the resin forming the key top block 90 except at the periphery thereof.

Figure 28:
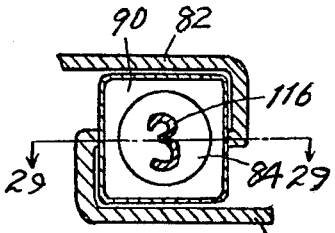
FIG. 28 is a plan view of still another embodiment of a pushbutton switch of the present invention.
Figure 29:
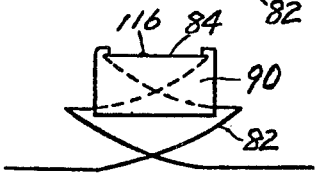
FIG. 29 is a schematic section view as seen at 29—29 of FIG. 28.

In the embodiment shown in FIGS. 28 and 29, a projection 116 specifying a desired numeral or function is formed on the key top surface 84 by utilizing the conventional etching technique. The key top surface 84 is covered by the resin forming the key top block 90 at the periphery thereof.

Figure 30:
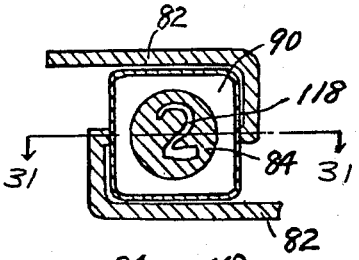
FIG. 30 is a plan view of yet another embodiment of a pushbutton switch of the present invention.
Figure 31:
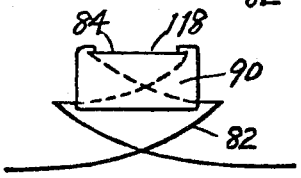
FIG. 31 is a schematic sectional view as seen at 31 — 31 of FIG. 30.

A slit 118 corresponding to the configuration of a desired numeral or a function mark is formed on the key top surface 84 with the use of the etching technique in the embodiment of FIGS. 30 and 31. The resin can be seen through the slit 118, whereby the operator can recognize the function of the key switch. The periphery of the upper surface of the key top surface 84 is covered with the resin forming the key top block 90.

Figure 32:
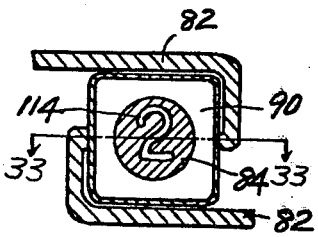
FIG. 32 is a plan view of a further embodiment of a pushbutton switch of the present invention.
Figure 33:
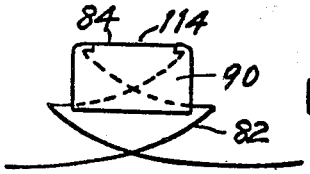
FIG. 33 is a schematic sectional view as seen at 33 — 33 of FIG. 32.

In the embodiment shown in FIGS. 32 and 33, the indent 114 is formed in a similar manner as the embodiment of FIGS. 26 and 27, and the marking portion is projected upward by virtue of the press forming treatment, thereby substantially flattening the upper surface of the key switch.

Figure 34:
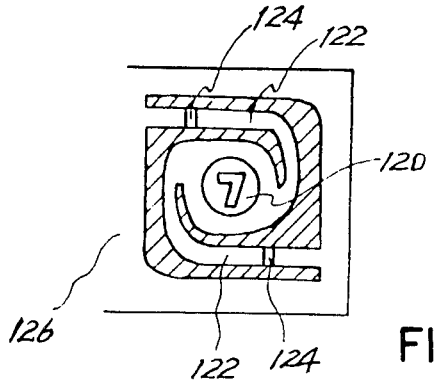
FIG. 34 is a plan view of another embodiment of a frame of a pushbutton switch of the present invention.
Figure 35:
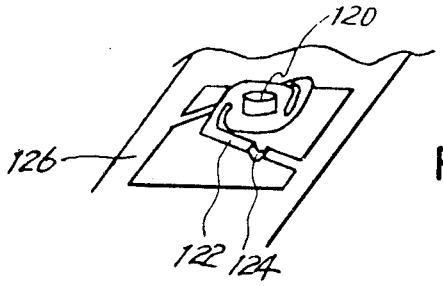
FIG. 35 is a perspective view of the frame of FIG. 34.

Referring now to FIG. 34, there is illustrated yet another embodiment of a pushbutton switch of the present invention in which a key top 120, spring means 122 and contacting means 124 are formed on a elastic metal plate 126 through the use of the etching technique previously described. The key top 120 is projected upward, whereas the contacting means 124 are projected downward with the use of the conventional press forming technique as shown in FIG. 35.

The above-mentioned pushbutton switch is installed on a substrate 128 via a spacer 130. Key contact patterns 132 and 134 are formed directly on the substrate 130 at the positions corresponding to the contacting means 124. The key top 120 is protruded through a hole provided on a cabinet 136 of an electronic apparatus.

Figure 36A:
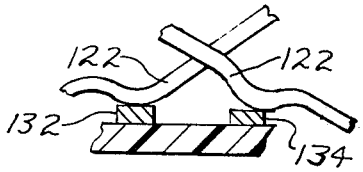
FIG. 36A is an enlarged detail of a closed condition of the switch contacts of FIG. 36.
Figure 36:
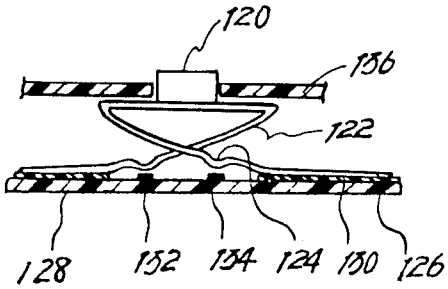
FIG. 36 is a sectional view of a pushbutton switch employing the frame of FIG. 34.

When the key top 120 is manually depressed downward, the contacting means 124 make contact with the key contact patterns 132 and 134, respectively, thereby shunting the key contact patterns 132 and 134 as shown in FIGS. 36 and 36A.

The invention being thus described, it will be obvious that the same way be varied in many ways. Such variations are not to be regarded as a departure from the spirit and scope of the invention, and all such modifications are intended to be included within the scope of the following claims.

What is claimed is:

1. A pushbutton switch key structure comprising:

a flexible unitary metal frame including a key top defining surface, a key top frame of metal strips integral with and dependent from said top surface;

an annular support shoulder integral with the lowermost end of said key top frame;

a plurality of actuating leaf spring means integrally affixed at one end to the periphery of said support shoulder and extending downwardly therefrom, and a metal base plate integrally affixed to the lower end of said spring means; and a solid block of molded resin integrated with said key top frame in a desired push-button key configuration;

said molded resin block and said key top defining surface being configured to define operating indicia on said pushbutton switch key structure.

2. The invention defined in claim 1, wherein said metal base plate is common to a plurality of said unitary metal frames, the latter being oriented in a desired keyboard configuration to provide a unitary keyboard array of said switch keys.

3. The invention defined in claim 2, wherein said indicia is defined by selective removal of said key top surface to provide indicia shaped aperture therein and said resin is visible through said aperture.

4. The invention defined in claim 2, wherein said resin overlies said key top surface, is substantially opaque and is selectively removed from said key top surface to expose a portion of said surface in the configuration of a desired indicia.

5. The invention defined in claim 1, wherein said indicia is defined by selective removal of said key top surface to provide indicia shaped aperture therein and said resin visible through said aperture.

6. The invention defined in claim 1, wherein said resin overlies said key top surface, is substantially opaque and is selectively removed from said key top surface in the configuration of a desired indicia.

* * * * *